United States Patent [19]

Tressler et al.

[11] Patent Number: 4,611,571

[45] Date of Patent: Sep. 16, 1986

[54] AUTOMATIC BALL THROWING MACHINE

[76] Inventors: Duane W. Tressler, 5008 Karlan Dr., Mobile, Ala. 36609; J. C. McLeod, P.O. Box 257, Grand Bay, Ala. 36541

[21] Appl. No.: 769,436

[22] Filed: Aug. 26, 1985

[51] Int. Cl.[4] ..... A63B 65/12

[52] U.S. Cl. ..... 124/7

[58] Field of Search ..... 124/7, 50

[56] References Cited

U.S. PATENT DOCUMENTS

| | | | |
|---|---|---|---|
| 202,301 | 4/1879 | Taltavull | 124/7 |
| 563,807 | 7/1896 | Rudolph | 124/50 X |
| 1,778,952 | 10/1930 | McCullough | 124/50 X |
| 1,897,317 | 2/1933 | McEachern | 124/50 X |
| 2,650,585 | 9/1953 | Farre, Jr. | 124/7 |
| 2,696,204 | 12/1954 | Gilgoff | 124/7 |
| 3,470,859 | 10/1969 | Ponza | 124/7 |
| 3,977,386 | 8/1976 | Meyer | 124/7 |

FOREIGN PATENT DOCUMENTS

| | | | |
|---|---|---|---|
| 1188498 | 4/1970 | United Kingdom | 124/7 |

*Primary Examiner*—Paul E. Shapiro
*Attorney, Agent, or Firm*—Frank P. Cyr

[57] ABSTRACT

An automatic ball throwing machine comprising a motorized arm for activating a ball receiving arm which is adapted to be positioned under a ball delivery chute and following the delivery of a ball into the receiving arm, a coil spring mounted at the other end of the receiving arm is released whereupon the receiving arm is caused to be projected upwardly and upon reaching its uppermost position the ball is released and projected toward one using the machine to practice hitting the ball with a suitable bat.

1 Claim, 6 Drawing Figures

AUTOMATIC BALL THROWING MACHINE

BACKGROUND OF THE INVENTION

Sportsmen and athletes have need to practice in hitting and catching thrown balls. To provide an automatic ball throwing machine, a number of machines have been built in the past but such machines have not proven to perform their intended function in a satisfactory manner. In the past, such ball throwing machines have entailed the construction of complex machines and even though these machines have met with a limited degree of success, the same have not been generally accepted by athletes for a number of reasons.

With the above in mind, it is one object of the invention to provide a simple, rugged self-contained ball throwing machine adapted to be operated automatically.

Another object of the invention is to provide an automatic ball throwing machine which can be operated electrically by use of ordinary B batteries.

Another object of the invention is to provide an automatic ball throwing machine which is simple in construction and which may be used by one desiring to practice hitting a ball in any environment such as in a home although the same may be equally effective when used out of doors.

Another object of the invention is to provide for an ample supply of balls to be projected from the machine when the same is energized by opening and closing of a manually operated switch.

These and other more specific objects will appear upon reading the following specification and claims and upon considering in connection therewith the attached drawings to which they relate.

DESCRIPTION OF THE PREFERRED EMBODIMENTS

Figure 1:
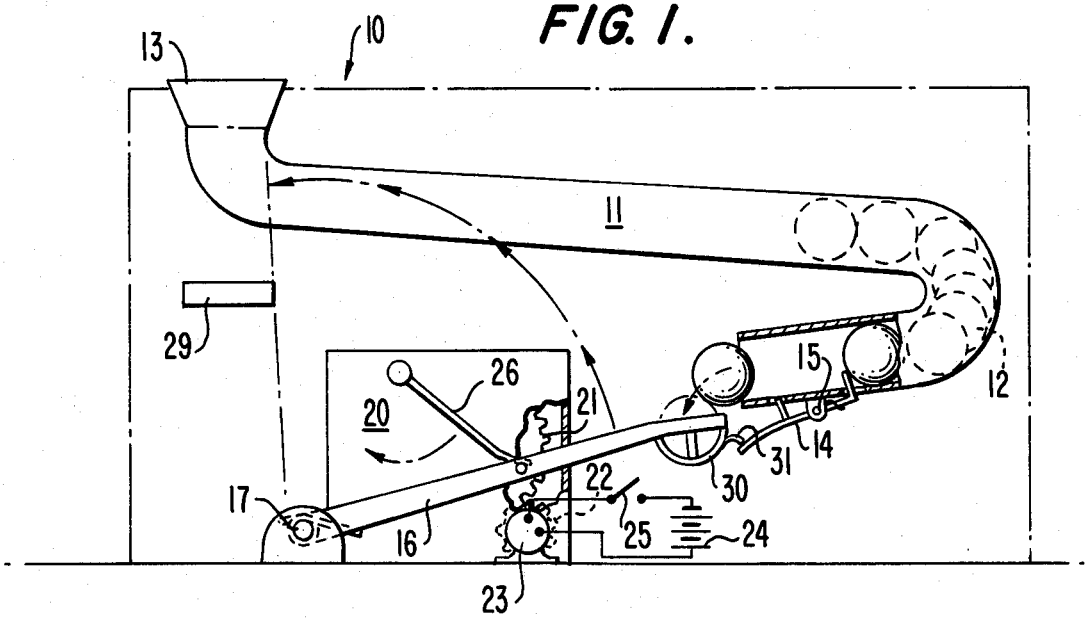
FIG. 1 is a side elevation with parts broken away disclosing the machine of the present invention.
Figure 2:
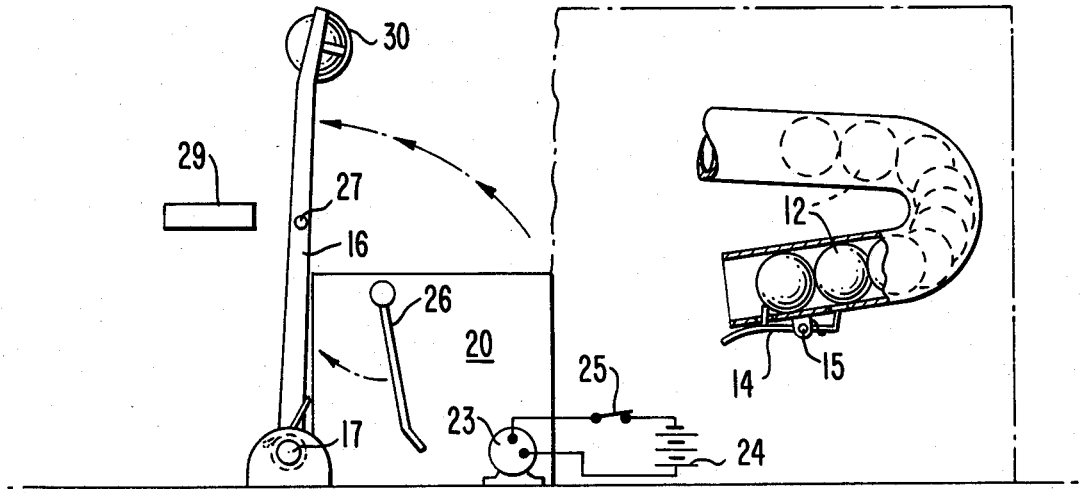
FIG. 2 is a side elevation of one end of the machine.

Referring now to the drawings wherein like reference numerals are employed to designate like parts throughout the several views, 10 designates the ball thrower of the present invention. 11 designates a reservoir for the balls 12. The reservoir consists of an elongated funnel-like formation open at one end 13 and having stop 14 pivoted as at 15 and is in the nature of a rocking lever and is designed to permit one ball to be released from the reservoir and to retain the remainder of the balls within the funnel until such time as another ball is to be projected by the machine in a manner to be described more fully hereinafter.

Figure 6:
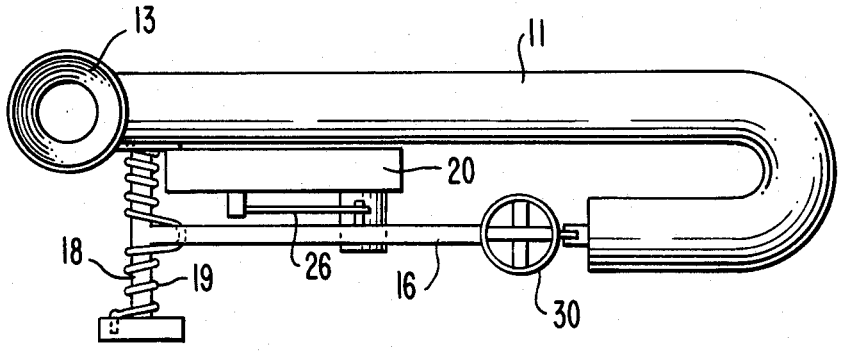
FIG. 6 is a top plan view of the ball thrower of the present invention.

A ball throwing arm 16 is pivoted as at 17 to a shaft 18 mounted in any manner to the side of the ball thrower and a coil spring 19 is secured to the shaft in any known manner and is adapted to exert a pressure against the throwing arm 16 when the machine is in operation. As can be best seen in FIG. 6 of the drawings, the spring 19 circles the shaft 18 with one section of the spring bearing against the underside of the throwing arm 16.

A cabinet 20 of known construction is provided and has mounted therein gearing 21 which is adapted to mesh with a gear 22 which extend from a shaft mounted for rotation on a DC motor 23 which derives its power from conventional B batteries 24. A manually operated switch 25 is provided in the line extending from the said motor and said batteries.

Figure 3:
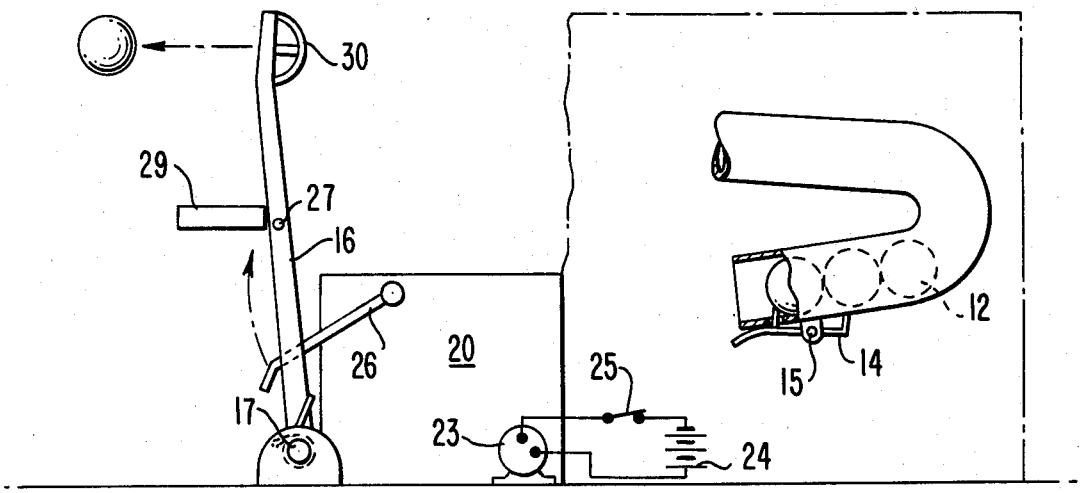
FIG. 3 is a side elevation showing the ball throwing arm projecting a ball in the direction of the arrow.
Figure 4:
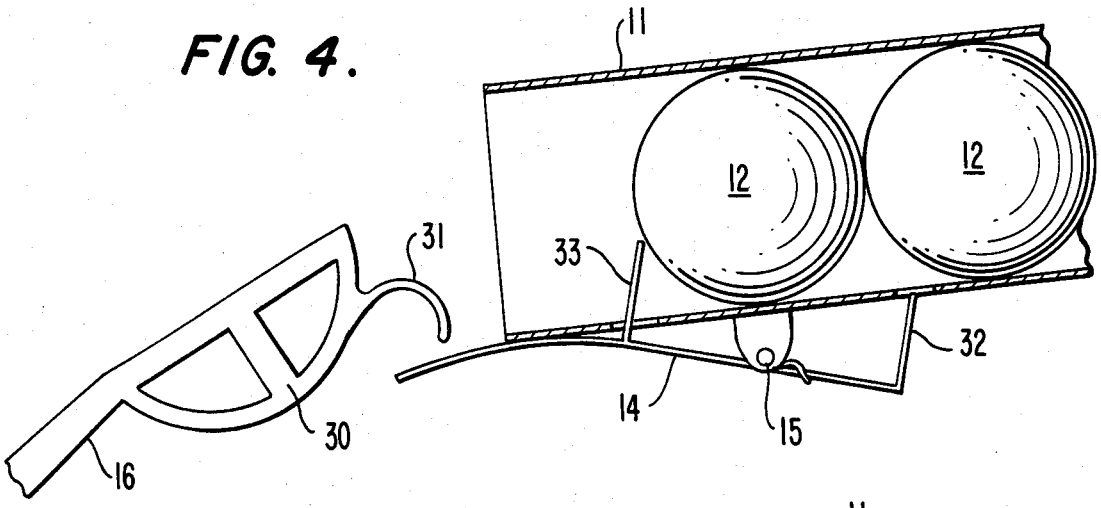
FIG. 4 is an enlarged view showing the ball delivery funnel in closed position.
Figure 5:
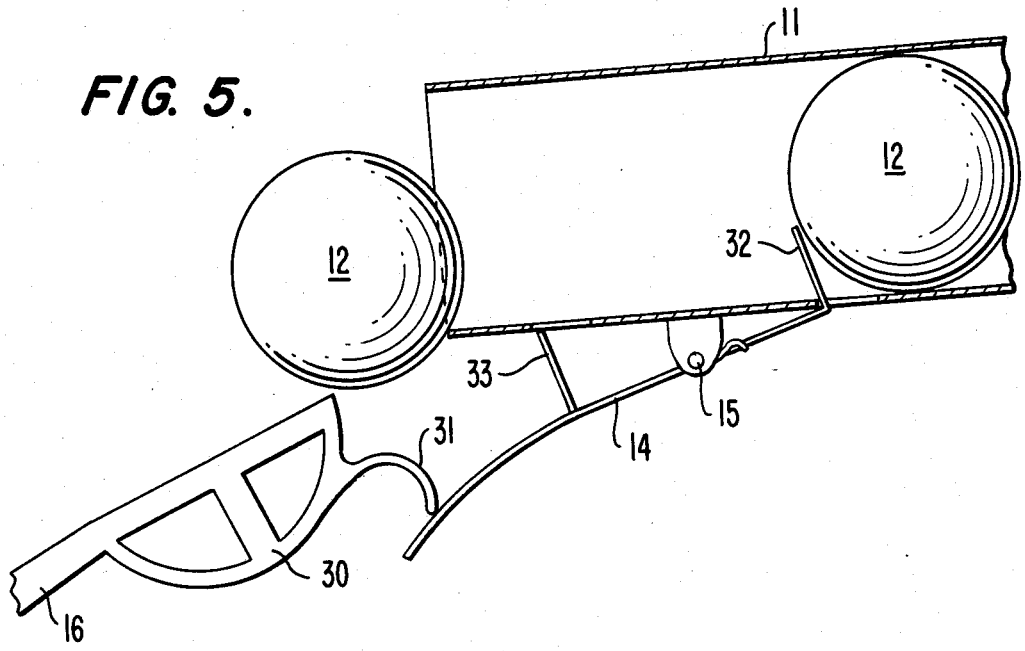
FIG. 5 is an enlarged view similar to FIG. 4 but showing the delivery funnel in open position.

Mounted for rotation on the cabinet 20 is a pivoted arm 26 which is adapted to rotate in the direction of the arrows and when the arm 26 is in the position shown in FIG. 1 of the drawings, one end of the arm 26 engages a stop 27 mounted along the length of the arm 16 and upon rotation of the arm 26 the lower end thereof 28 proceeds past the stop 27 thereby disengaging the stop and permitting the arm 16 to swing in the direction of the arrows under the force exerted by the spring 19. A bumper or stop 219 extends in the path of travel of arm 16 and acts as a bumper for the arm 16 thus causing a release of the ball from the arm 16 and thus projecting the ball towards the person employing the ball throwing machine as indicated by the arrow shown in FIG. 3 of the drawings.

To load a ball into the upper basket 30, the extension arm 31 formed thereon engages one end 14 of the cocking lever and causes the same to pivot on pivot 15, thus causing said lever to extend a stop 32 into the path of the balls in the reservoir or funnel while simultaneously removing the exit stop 33 from the funnel and permitting a ball to drop into the basket 30. Following the placement of a ball in the basket as aforesaid, rotation of the arm 26 will continue until the same travels past the stop 27 whereupon the arm 16 will be swinging upwardly under the force exerted by the coil spring 19. When the arm 16 contacts the bumper 29, the arm will come to a complete stop thus projecting the ball from the basket.

Following the projection of the ball as aforesaid, the machine will continue to operate as long as the motor is energized and the operation repeated as long as the energy is supplied to the motor.

While the particular automatic ball thrower for use by athletes herein shown and described in detail is fully capable of attaining the objects and providing the advantages hereinbefore stated, it is to be understood that it is merely illustrative of the present preferred embodiments of the invention and that no limitations are intended to the details of construction or design herein shown other than as defined in the following claims.

We claim:

1. In an improved and simplified, automatic ball throwing apparatus:

a catapult beam pivotally mounted at one end on a shaft extending transversely thereto;

a follower rod fixed to and extending laterally from a side face of the beam and spaced from and parallel to said shaft;

a torsion spring helically coiled at its end sections around a respective end section of said shaft;

the spring ends being preferably fixed to respective sidewalls of the apparatus;

the spring midsection being formed as a torque exerting loop that is in a cantilevered engagement with the backside of the catapult beam;

a bumper stop operatively associated with the front side of the beam and disposed at the release or throwing position of said beam;

a frontally facing ball receiving basket disposed on the free end of the beam;

a ball feeding magazine tube having a dispensing mouth operatively associated with said basket and adapted to retain in the tube a row of said balls from which the magazine is further adapted to gravity feed but one ball to said basket per a single throwing stroke of the catapult beam;

an arm pivotally mounted at an intermediate section thereof on the underside of said tube;

a first element extending from an intermediate section of the arm that is forwardly of the arm's pivot point as defined by the arm's pivotal mounting;

said first element being of a length whereby to normally extend through a first tube lower wall aperture and into a stopping position with respect to a first lead ball in the tube;

bias means normally biasing said arm to position said element in said stopping position;

a second element extending from a rear section of said arm and adapted to extend through a second tube lower wall aperture and into a stopping position, with respect to the second lead ball of said row of balls, when the arm is pivoted from its normal biased position to withdraw the first element from its lead ball stopping position;

a lead section of said arm extending forwardly of the magazine's dispensing mouth;

a rearwardly extending lip on said basket operatively associated with said lead section of the arm;

whereby at an extreme of rearward beam travel, the basket is disposed at a ball receiving position and the lip is adapted to simultaneously bear down on the arm's lead section to thereby effect pivotal motion of the arm from its normal biased position to thereby move the second element to its ball stopping position while simultaneously carrying the first element out of its lead ball stopping position for release of said lead ball to gravity deposit in said pocket;

a single actuator rod mounted at one end for continuous rotation about its mounting and motor means to effect said continuous rotation;

said actuator rod being configured with an axially extending camming surface at its free end;

said actuator rod mounting being spaced from the beam mounting and the angular travel of said camming surface in part overlapping the angular travel of the follower rod effected by said pivotal motion of the beam;

said camming surface being operatively associated with said follower rod and adapted, upon rotation of the actuator rod, to engage and bear frontally upon the follower rod whereby to initiate said overlapping angular travel of the camming surface and the follower rod;

the actuator rod and camming surface thereof is further adapted upon continued angular travel thereof to continually bear on the follower rod whereby to move the catapult beam from a rest position, backwards against resistance of the torsion spring to a final position of said overlapping travel whereat a maximum of energy is stored in the torsion spring and during which travel the rearwardly extending lip on the basket engages and bears against said lead section of the pivotally mounted arm to thereby effect the aforedescribed pivotal travel of the arm from said normal position for release of the lead ball;

beyond said final position of overlapping angular travel, the camming surface is adapted to lose contact with the follower rod whereby the looped torsion spring is adapted to freely release its stored energy to thereby snap the beam forwardly to pivotally hurl the beam against the bumper stop whereupon the ball carried in the basket is thrown or catapulted into space; and said catapult beam and pivotally mounted arm being adapted for repetitions of said described movements during rotations of said actuator rod.

* * * * *